US005992056A

United States Patent [19]

Lohrmann

[11] Patent Number: 5,992,056

[45] Date of Patent: Nov. 30, 1999

[54] ANTI-PERSONNEL MINE PROTECTIVE FOOTPAD

[76] Inventor: Richard H. Lohrmann, 5131 Rives Rd., Elmore, Ala. 36025

[21] Appl. No.: 09/231,308

[22] Filed: Jan. 13, 1999

Related U.S. Application Data

[60] Provisional application No. 60/071,036, Jan. 13, 1998.

[51] Int. Cl.[6] ..... A43B 13/38; A43B 13/22

[52] U.S. Cl. ..... 36/44; 36/75 R; 36/76 C

[58] Field of Search ..... 36/73, 75 R, 76 C, 36/44, 113

[56] References Cited

U.S. PATENT DOCUMENTS

| | | | |
|---|---|---|---|
| 2,920,008 | 1/1960 | Frieder et al. | 36/73 |
| 3,461,575 | 8/1969 | Tead et al. | 36/73 |
| 5,003,709 | 4/1991 | Okayasu et al. | 36/73 |
| 5,285,583 | 2/1994 | Aleven | 36/73 |

*Primary Examiner*—M. D. Patterson
*Attorney, Agent, or Firm*—George L. Williamson

[57] ABSTRACT

The present invention discloses a footpad or inner sole to be used and worn inside the boot or shoe of military or civilian personnel exposed to dangerous environments in order to prevent injury to the user from being in the vicinity of an explosive device while it explodes. The present invention consists of several layers of effectively strong material comprising approximately 30 layers in total. In one embodiment therein are about 15 layers of a first effectively strong fabric underneath about 15 more layers of the first effectively strong fabric alternating with the second effectively strong fabric. Test have shown this combination to be exceedingly strong and to provide protection to the user from explosive devices and, furthermore, tests have shown that one effectively strong combination results in an embodiment wherein the first fabric is KEVLAR and the second fabric is SPECTRA.

7 Claims, 2 Drawing Sheets

ANTI-PERSONNEL MINE PROTECTIVE FOOTPAD

BACKGROUND OF THE INVENTION

This application is a Continuation of Provisional Application Ser. No. 60/071,036 filed Jan. 13, 1998.

1. Field of the Invention

The present invention relates generally to footpads and/or material for footpads and, more particularly, to footpads and material used to prevent injury to the body of a user due to explosive devices.

2. Description of the Prior Art

Devices for footpads have been described in the prior art; however, none of the prior art discloses the unique features of the present invention.

In U.S. Pat. No. 4,893,418, dated Jan. 16, 1990, Ogden disclosed an insole for a shoe, and method of manufacture, which comprises a bottom layer formed of cushioning material, and a top layer formed with apertures, which, in various methods of manufacture, is embedded into the bottom layer so that the cushioning material forming the bottom layer extends at least partially into the aperture in the top layer. The coefficient of friction of the top layer of the insole which contacts the foot of the wearer is variable and chosen to control the movement of the foot along the insole depending upon the type of activity and playing surface for which the shoe is designed.

In U.S. Pat. No. 4,973,376, dated Nov. 27, 1990, Chiu disclosed a method for manufacturing an air-pervious insole being uneasily deformable. The method includes preparing from a foaming material an elastic base piece having through holes, cutting from the base piece a layer of the foamed material to present a rough surface, adhering a cloth layer on the rough surface, then baking to soften the base piece, then molding in a cooling mold, and finally cutting the cooled and molded piece to obtain an air-pervious insole.

In U.S. Pat. No. 5,392,533, dated Feb. 28, 1995, Gerhartl disclosed an insole which contains an absorbent layer which is arranged on a stabilization layer. The stabilization layer is made of a fibrous and sealable material, the fibers running predominantly in the longitudinal direction of the insole. On the absorbent layer, there is a covering layer which is likewise made of a sealable material. Depressions are provided, the side walls of which are formed by continuations of the material of the covering layer. The edges of these side walls are connected rigidly to the stabilization layer so that, between the neighboring depressions, there are bridges made from the material of the covering layer, which reinforce that section of the stabilization layer lying below. With the given and minimal thickness, the insole is remarkably rigid and durable.

In U.S. Pat. No. 4,823,420, dated Apr. 25, 1989, Bartneck disclosed a contour molded insole for footwear and method for producing the same to conform to an individual's foot which includes at least one layer of material which is provided with plasticity for permitting shaping of the insole. An insole blank is shaped to include an upwardly concave surface portion which, under pressure, is caused to invert to form a convex surface. The insole is provided with a heelbone relief portion and layers of textile and cushioning material for completing a preferred embodiment.

In U.S. Pat. No. 4,864,740, dated Sep. 12, 1989, Oakley disclosed a disposable hygienic shoe insole which comprises three layers: a top layer of a spunbonded polypropylene material, a composite layer of pulp fibers and polypropylene fibers meltblown onto the top layer, and a bottom layer of polyethylene vinyl acetate meltblown onto the composite layer. The layers, preferably the composite layer, can include antimicrobial agents, fragrance, or neutralizer or odor-absorbing agents. The top surface of the top layer is provided with good abrasion resistance, and the bottom surface of the bottom layer provides required friction to maintain the shoe insole in place during use.

While these footpad devices may be suitable for the purposes for which they were designed, they would not be as suitable for the purposes of the present invention, as hereinafter described.

SUMMARY OF THE PRESENT INVENTION

The present invention discloses a footpad or inner sole to be used and worn inside the boot or shoe of military or civilian personnel exposed to dangerous environments in order to prevent injury to the user from being in the vicinity of an explosive device while it explodes. The present invention consists of several layers of effectively strong material comprising approximately 30 layers in total. In one embodiment therein are about 15 layers of a first effectively strong fabric underneath about 15 more layers of the first effectively strong fabric alternating with the second effectively strong fabric. Test have shown this combination to be exceedingly strong and to provide protection to the user from explosive devices and, furthermore, tests have shown that one effectively strong combination results in an embodiment wherein the first fabric is KEVLAR and the second fabric is SPECTRA.

An object of the present invention is to provide a protective layer to a boot or shoe or like footwear being worn on the foot to prevent loss of toes, feet, legs, etc., from explosions. Another object of the present invention is to provide a protective layer to be worn in a boot underneath the foot to prevent foreign objects from penetrating the toes, feet, legs or lower body of the user. Another object of the present invention is to provide a protective layer in the boot to be worn underneath the foot to prevent loss of toes, feet, legs, etc. due to trauma and/or infection. Another object of the present invention is to provide a protective layer in the boot to be worn underneath the feet to reduce the cost of foot and leg injury, surgery and extensive rehabilitation from injuries due to explosions. A further object of the present invention is to provide extended life to the boot by virtue of the durability of the footpad aside from its explosives resistance.

Military or civilian personnel can be exposed to many different battlefield or other hostile actions. Some protection is provided them from flak jackets, steel soles in boots, and KEVLAR helmets worn about their heads, etc. By tradition, such personnel have not had any adequate foot protection from explosion of mines. The footpad of the present invention when incorporated with a boot can prevent dirt, debris, shoe parts, blood/bone fragments and shrapnel from separating or penetrating the foot or lower body area following an explosion. The anti-personnel footpad can be made of a combination of KEVLAR and SPECTRA stitched together.

Additional objects of the present invention will appear as the description proceeds.

The present invention overcomes the shortcomings of the prior art by providing a footpad which provides protection to the foot of the user due to nearby explosives.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
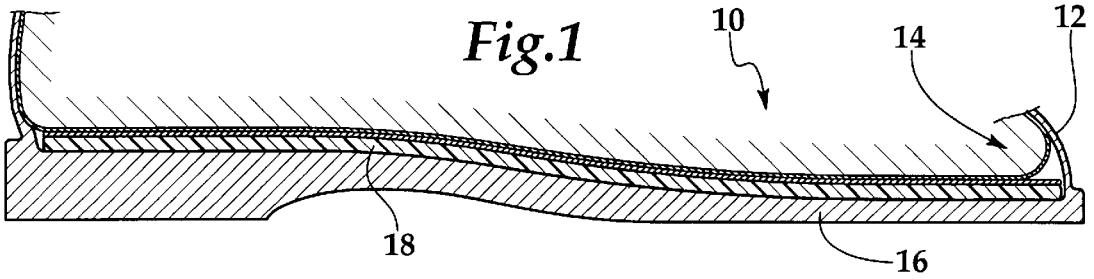
FIG. 1 is a cross-sectional view of a foot inside a shoe containing the present invention.

With regard to the reference numerals used, the following numbering is used throughout the drawings.

10 present invention

12 shoe

14 foot

16 sole of the shoe

18 footpad

22 first fabric

24 cross stitching

26 edge stitching

28 second fabric

DESCRIPTION OF THE PREFERRED EMBODIMENT(S)

Turning now descriptively to the drawings, in which similar reference characters denote similar elements throughout the several views, FIGS. 1 through 6 illustrate the present invention being a footpad for minoring injuries due to nearby explosions.

Turning to FIG. 1, therein is shown cross-sectional view showing the present invention 10 in operative connection with a shoe 12. The foot of the user is shown at 14 and a sole of the shoe is shown at 16 and the footpad of the present invention is shown at 18. The footpad 18 is shown being worn underneath the foot 14 between the foot 14 and the shoe sole 16. Therefore, if the user stepped on a land mine or other explosive device, the footpad 18 would be positioned so as to be between the user and the explosion and likewise the force resulting from the explosion. Footpad 18 is made of approximately 30 layers of effectively strong material.

Figure 2:
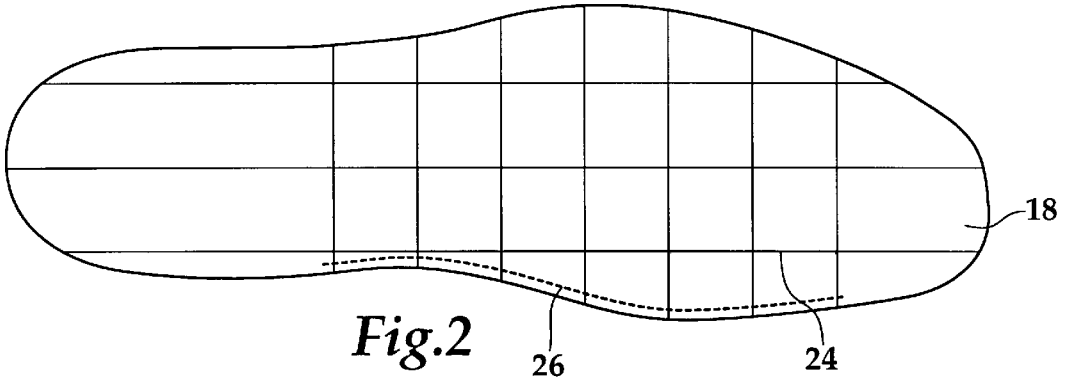
FIG. 2 is a plan view of the present invention.

Turning to FIG. 2, therein is shown the present invention 10 in plan view. The footpad is shown at 18 along with the stitches which are used to attach all the layers of materials to each other. The stitches can be of fabric, nylon or like material that is used in standard practice. Note that cross stitching 24 is provided along with edge stitching 26 which travels entirely around the perifery of the footpad even though FIG. 2 shows only the stitching travelling partially around the footpad and that needle penetration is not more than one inch apart.

Figure 3:
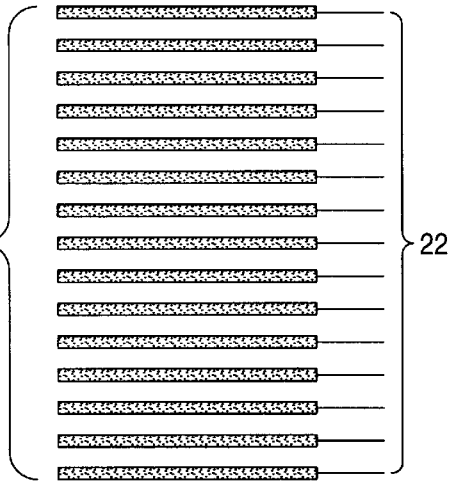
FIG. 3 is an elevation view of selected layers of the present invention.

Turning to FIG. 3, therein is shown an elevation view of selected layers of selected material 22. Note that there are approximately 15 total layers of effectively strong material which make up this portion of the footpad 18. Each of these layers contiguous to each other could be of the same type of material which are stitched together by way of edge stitching 26.

Figure 4:
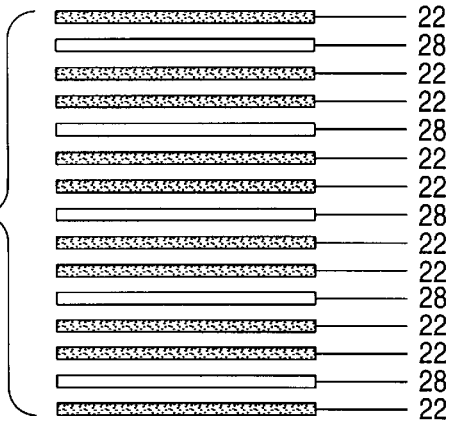
FIG. 4 is an elevation view of selected the layers of the present invention.

Turning to FIG. 4, therein is shown an elevation view of selected layers of effectively strong material 22 and 28. Note that there are approximately 15 total layers of material constructed so that one layer of one type of effectively strong material 28 is sandwiched between two layers 22 of another type of effectively strong material by means of cross stitching 24. The footpad 18 is comprised of 13–17 layers, more particularly, is comprised of the 15 layers of material constructed as shown in FIG. 3 in addition to the 13–17 layers, more particularly, 15 layers of material constructed as shown in FIG. 4, i.e., the 15 layers of FIG. 3 in addition to the 15 layers of FIG. 4 to make up the total layers of 30. It is believed that the first fabric being KEVLAR or the like should have a denier range of 900–1100, and, the second fabric being SPECTRAR or the like should have a denier range of 550–750.

Figure 5:
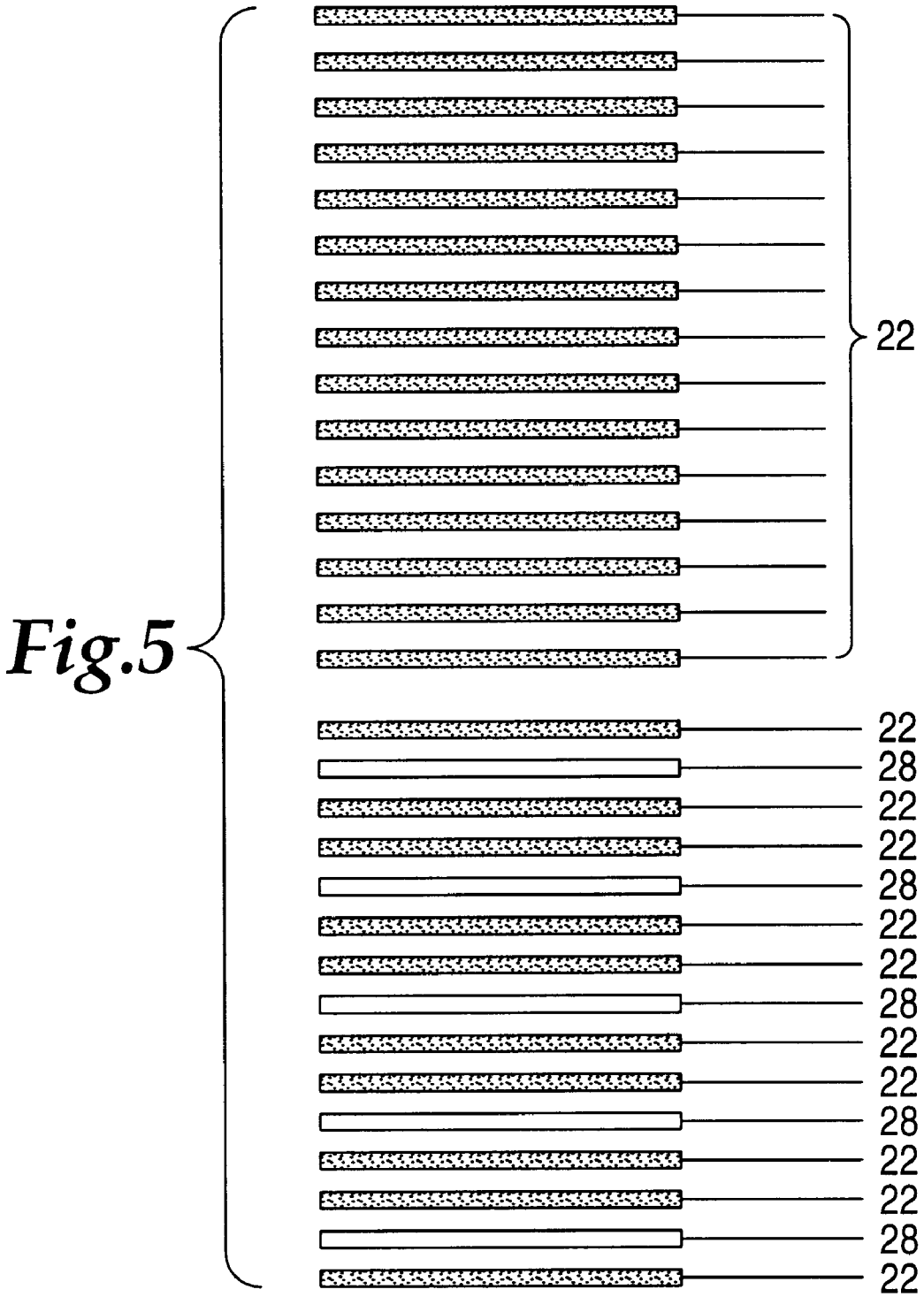
FIG. 5 is an elevation view of the composite layers of the present invention.

Turning to FIG. 5, therein is shown an elevation view of the 15 layers of the first material and the 15 layers of the first and second materials.

An Example follows which further defines and teaches various aspects of the present invention.

EXAMPLE 1

Laboratory testing at a qualified laboratory has been conducted. The lab conducted Ballistic Limit, Protection (V50BLP) testing of a soft woven aramid fiber test panel.

Testing was conducted in accordance with the procedures of MIL-STD-662E, dated Jan. 22, 1987 using SABOTTED caliber .22, 17.0 grain fragment simulators. The test sample was mounted on an indoor range 15.0 feet from the muzzle of a test barrel to produce zero degree obliquity impacts. Lumiline screens were positioned at 5.0 and 10.0 feet which, in conjunction with an elapsed time counter (chronograph), were used to compute projectile velocities 7.5 feet from the muzzle. Standard drag coefficient tables for fragment simulating projectiles were used to calculate striking velocities. Penetrations were determined by visual examination of a 0.020 inch thick sheet of 2024T3 aluminum positioned 6.0 inches behind and parallel to the test sample.

Summary of Results

| Test Sample | | | Ballistic Threat | | Ballistic Limit (fps) | | |
|---|---|---|---|---|---|---|---|
| Number | Weight (lbs) | Plies | Calliber(a) | Shots | V50 BL(P) | High Partial | Low Complete |
| 15 | 4.40 | 30 | 22 F.S. | 16 | 1986 | 2018 | 1978 |

(a)Sabot fired

The fabric for this test Example was constructed according to the teachings of this application. The KEVLAR fabric used was 1000 denier KEVLAR 29 fabric, FDI style 095, weight 8.3 oz. per sq. yd., warp 31 and fill 31, plain weave, thickness 0.016 inch, 50 inch. wide. The SPECTRA fabric used was Fabric 509, W/E 54 inch, denier 650, weight 11.5 oz. per sq. yd., warp 34 and fill 34, and is believed to be laminated with ethylene vinyl astene (or estene) commonly referred to as EVA. It is believed that fabrics constructed approximately the same as these test fabrics would be acceptable, i.e., with values in about 10% plus or minus of the stated values, or, KEVLAR with denier ranging from 900–1000 with weights of 7.3–9.3 oz. per sq. yd. and SPECTRA with denier ranging from 550–750 with weights of 10.5 to 12.5 oz. per sq. yd.

The fabrics used in the present invention work by catching the bullet in a net-like web of very strong fibers. The bullet stretches not only the few fibers it hits, but also others in contact with them and many more that those pull. As in any net, the key to success is that many fibers, even those not actually touching the bullet, elongate in response to the collision and so absorb the energy of the bullet. Even so, materials available today do not permit the construction of a vest from a single ply of fabric—a number of layers often about one or two dozen, are needed to stop a bullet.

Today, several types of polyaramid fiber are marked under the name KEVLAR (by the DuPont de Nemours Co., Inc.). This fiber is woven into fabric by weavers (two or three produce most of the U.9. ballistic fabric), and the fabric is used in the construction of vests by several U.S. and foreign manufacturers. More recently, this type fabric has been made from fibers of extended chain polyethylene (ECPE). Produced by Allied-Signal, Inc., the fiber marketed as SPECTRA, has greater tenacity and slightly less elongation than KEVLAR.

KEVLAR is strong fiber made from polymeric aromatic amide (polyaramid) plastic by dissolving it in a special solvent and spraying the solution through a small nozzle called a spinneret. The solvent evaporates, leaving the plastic fiber, which has a strength to weight ration about five times that of steel. The possibility of making polyaramid plastic was hypothesized in 1939. It was synthesized and identified at DuPont in 1960, but polyaramid fiber could not be produced until 1965 when a practical solvent was discovered.

Before KEVLAR was used for body armor, it was used as a substitute for steel in the manufacture of radial tires, including those designed for police cars, it does not melt but does pyrolyze (decompose) at very high temperature. It loses some strength as its temperature is increased but remains strong enough to be used for applications requiring high strength to weight ration at high temperature—e.g., in the telescoping nozzles of solid-fuel rocket motors of the Peacekeeper (formerly MX) missile.

KEVLAR is a registered trademark of DuPont de Nemours and Co., Inc. SPECTRA is a registered trademark of Allied-Signal, Inc., for the high strength synthetic fibers the company produces form extended chain polyethylene (ECPE). Key properties of these fibers (marketed under the brand name SPECTRA 1000) include low weight and high strength, as well as resistance to impact, moisture, abrasion, chemicals, and puncture.

SPECTRA fibers are made by a process called gel-spinning. Extended chain polyethylene molecules containing 70,000 to 350,000 carbon atoms are dissolved in a solvent which is heated and forced through tine nozzles called spinnerets. The resulting jets of solution cool and harden into plastic fibers, which are drawn, dried, and wound onto spools for further steps in manufacturing. This fiber producing process aligns the extended chain polyethylene molecules so that the hydrogen atoms of each molecule bond with those of its neighbors. This gives SPECTRA a tensile strength greater than aramid fibers. SPECTRA is also less dense that other fibers, its specific gravity is only 0.97, so it floats. Pound for pound, it is 10 times as strong as steel.

Another notable characteristic of Spectra Shield (TM) is the high velocity—12,300 m/s—at which the stress imparted by a bullet propagates within the armor outward from the point of impact, which allows the bullet's energy to be absorbed by a large area of the armor. In the 1 to 2 milliseconds during which a low-energy bullet is decelerated by armor and backing material, (100) part of the energy would be distributed over and absorbed by the entire ballistic panel. SPECTRA fabric and Spectra Shield (TM) can be ignited but only when their temperature reaches 675 F., they are less flammable than cotton or polyester fabrics typically used for police uniforms. Flame-retardant tactical armor has been made by enclosing Spectra Shield (TM) in a carrier garment made of flame-retardant fabric. Spectra® melts at a temperature of 160 F. Armor so hot would be excruciatingly painful and would burn skin in less than a second, so ballistic resistance at so high a temperature is almost irrelevant.

Extensive experimentation has determined that one combination of fabric which gives outstanding protection is for the first effectively strong material to be KEVLAR (Item Number 22 of this Specification) and for the second effectively strong material to be SPECTRA (Item Number 28 of this Specification). Of course, other materials may be acceptable such as aramid or other like fabrics.

The present invention will prevent the loss of the leg of a user due to elimination of the leg trauma by massive infection throughout the lower body resulting from an explosion. The subsequent elimination of the infectious material to the victim will also prevent the massive widespread infection activity. Items such as dirt, debris, body parts, shoe material, blood/bone fragments and shrapnel will not therefore present a threat to the lower body. This pad will prevent those projectiles from penetrating and severing the foot and also prevent them from reaching other areas of the lower body area. The large amounts of exploding projectiles from an exploding mine will be returned away from the body without harming the lower body area.

Accordingly, it should be clear that the anti-personnel protective foot pad of the present invention can be used to prevent the loss of blood, tissue, bone and to elimination of leg trauma and toes/foot or lower body damage and subsequent infectious activities. Items such as dirt, debris, body parts, blood/bone fragments and shrapnel are not likely to penetrate the body area from mine explosion.

What is claimed to be new and desired to be protected by Letters Patent is set forth in the claims:

1. An apparatus for protecting humans against explosion, comprising:

a) a plurality of layers of a first fabric;

b) a plurality of layers of a second fabric;

c) a footpad comprised of said first and said second layers of fabric, said footpad further comprising a first portion and a second portion;

d) said plurality of layers of said first fabric further comprising about 15 layers; said 15 layers of said first fabric contiguous to each other comprising said first portion of said footpad; and, e) said plurality of layers of said second fabric further comprising five layers of said second fabric having each layer of said second fabric sandwiched between two layers of said first fabric forming a total of 15 layers of said first and second fabric comprising said second portion of said footpad.

2. The apparatus of claim 1, wherein said first portion of said footpad further comprises 13–17 layers.

3. The apparatus of claim 1, wherein said first fabric has a denier ranging from 900 to 1100.

4. The apparatus of claim 1, wherein said first fabric has a denier of about 1000.

5. The apparatus of claim 1, wherein said second fabric has a denier ranging from 550–750.

6. The apparatus of claim 1, wherein said second fabric has a denier of about 650.

7. A method of forming a fabric for protecting humans against explosion, comprising the steps of:

a) providing about 25 layers of a first fabric;

b) providing about 5 layers of a second fabric;

c) forming a first portion of a footpad by placing about 15 layers of said first fabric contiguous to each other;

d) forming a second portion of a footpad by sandwiching one layer of said second fabric between two layers of said first fabric, said second portion comprising a total of about 15 layers of fabric; and, e) forming said first and said second portions of a footpad into a footpad to be worn inside footwear disposed under the foot of the user whereby the user is protected from explosion.

* * * * *